United States Patent [19]

Sessink

[11] 4,067,296

[45] Jan. 10, 1978

[54] MAGNETIC ROLLER

[75] Inventor: Bernardus Wilhelmus L. M. Sessink, Venlo, Netherlands

[73] Assignee: Oce-van der Grinten N.V., Venlo, Netherlands

[21] Appl. No.: 715,639

[22] Filed: Aug. 18, 1976

[30] Foreign Application Priority Data

Aug. 20, 1975 Netherlands ..... 7509870

[51] Int. Cl.[2] ..... B05B 5/02

[52] U.S. Cl. ..... 118/658; 355/3 DD; 118/657

[58] Field of Search ..... 118/657, 658; 29/132; 355/3 DD

[56] References Cited

U.S. PATENT DOCUMENTS

| | | | |
|---|---|---|---|
| 3,233,587 | 2/1966 | Morton | 118/657 |
| 3,464,383 | 9/1969 | Knechtel | 118/657 |
| 3,557,751 | 1/1971 | Kushiwa | 118/657 |
| 3,643,311 | 2/1972 | Knechtel et al. | 29/132 |

FOREIGN PATENT DOCUMENTS

| | | | |
|---|---|---|---|
| 2,224,624 | 11/1972 | Germany | 355/3 DD |

*Primary Examiner*—Ronald Feldbaum

*Attorney, Agent, or Firm*—Albert C. Johnston; Gerard F. Dunne

[57] ABSTRACT

A magnetic roller comprising a diamagnetic cylinder rotatable about magnets extending axially inside the cylinder is made to inhibit escape of magnetically attractable powder particles from the surface of the cylinder by providing the magnets, or a cylindrical magnet composed of several of them, with means which form in the magnetic field near each end of the cylinder a spirally extending bandlike field range which deviates in field strength from that existing in other regions of the cylinder surface. The bandlike ranges preferably have a reduced field strength and are formed by grooves made in the surface of the magnets and/or by applied strips of material having a greater magnetic permeability than air. They preferably extend from the extremities of the magnets spirally inward in the direction of the rotation of the cylinder, so that powder particles will be displaced inwardly from them as the cylinder rotates.

16 Claims, 3 Drawing Figures

MAGNETIC ROLLER

This invention relates to a magnetic roller comprising a rotatable cylinder within which magnets extending in axial direction are installed so that the magnets generate a magnetic field over at least a part of the circumference of the cylinder.

Magnetic rollers of that kind are known. For instance, in French Pat. Spec. No. 1,566,007 such rollers are used to transport magnetically attractable developing powder in an apparatus for the development of latent electrostatic charge images.

The known magnetic rollers as used to transport such powder have a disadvantage in that, under the influence of the magnetic fields extending from the extremities of the magnet, a part of the powder applied onto the cylinder surface near those extremities is transported towards the extremities of the cylinder, where the powder can fall down from the cylinder and either enter into the bearings of the roller or be flung away from the cylinder so as to pollute the apparatus in which the roller is used.

In German Offenlegungsschrift No. 2,242,367 it has been proposed to eliminate these disadvantages by providing each extremity of the cylinder with a non-magnetic collar which blocks the powder. This solution, however, is not satisfactory, because in the course of time the powder accumulates near the collars so that powder particles then fall over the collars into the roller bearings, and particles are flung away from the cylinder.

In another proposed remedy, scrapers are installed at each extremity of the cylinder so that they will direct the powder transported toward the cylinder extremities back toward more inward parts of the cylinder. Such scrapers have not proved satisfactory because, again, the powder frequently accumulates on them so that powder particles are flung away into the environs. Moreover, powder particles may jam between the scraper and the cylinder, then making scratches in the cylinder surface or causing jamming of the cylinder.

The object of the present invention is to provide an improved magnetic roller by which the above-mentioned disadvantages can be overcome.

According to the invention, a magnetic roller is provided which comprises a rotatable cylinder within which magnets extending in axial direction generate over at least a part of the cylinder surface a magnetic field which has a spirally extending bandlike range near each extremity of the cylinder, in which range the field strength at any point deviates from the field strength at any point lying on the same descriptive in the range or region of the cylinder surface between the bandlike ranges.

It has been found that by this arrangement, without need for auxiliary mechanical means such as scrapers, magnetically attractable powder supplied to the more inward parts of the cylinder cannot reach the two extremities of the cylinder but moves in axial direction only up to the edges of the bandlike field ranges and then moves further along these edges, because the magnetic field has a greater divergence along these edges. When the cylinder of the roller is rotated in the direction in which the bandlike ranges extend axially inward, a powder transport directed continuously inward takes place near the extremities of the cylinder along the edges of the bandlike ranges.

According to a preferred embodiment of the invention the field strength at any point of each bandlike range is lower than the field strength at any point lying on the same descriptive in the intermediate range, and this lower field strength is obtained by making, near each extremity, a spirally extending groove in the surface of the magnets which generate the magnetic field, or by installing between the magnets and the cylinder of the roller a spirally extending strip of a material which has a greater magnetic permeability than air.

The invention will be further understood from the following description of illustrative embodiments, wherein reference is made to the accompanying drawings in which.

Figure 1:
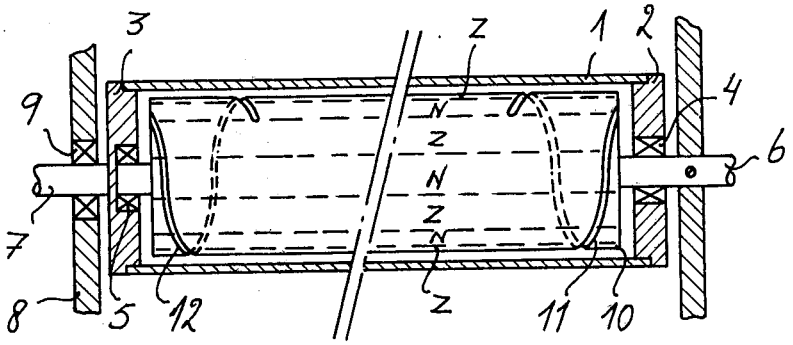
FIG. 1 is a schematic cross sectional view of a magnetic roller according to a preferred embodiment of the invention.

The magnetic roller as shown in FIG. 1 comprises a cylinder 1 made of diamagnetic material, for instance brass, aluminum or stainless steel, the extremities of which are closed by end plates 2 and 3. The shaft 6 of the roller is mounted in bearings 4 and 5 seated in the end plates 2 and 3. The shaft extends from bearing 4 to a side frame to which it is fixed so that magnets mounted on this shaft inside the cylinder 1 do not rotate. A projection 7 of the shaft 6 extends from the end plate 3 through a bearing 9 mounted in sideframe 8, forming a journal to which drive means (not shown) are connected for rotating the cylinder 1 about the magnets.

The shaft 6 is composed of a material having a high magnetic permeability, for instance soft iron. It supports firmly inside the cylinder a cylindrical magnet 10 the outer diameter of which is smaller than the inside diameter of the cylinder 1. The cylindrical magnet 10 is composed of a plurality of radial magnetized regions or segments, for instance 12 of them, which extend in axial direction and are arranged so they present north and south poles alternately about the surface of the magnet.

A spirally extending V-shaped groove 11 or 12 is made in the surface of the cylindrical magnet 10 near each end thereof. Each of these grooves extends slightly further than one circumference of the magnet 10, and the grooves 11 and 12 are opposite in pitch. As a result of the provision of the grooves 11 and 12 according to the invention, the magnet 10 generates at the surface of the cylinder 1 a magnetic field which has near each extremity of the cylinder a spirally extending bandlike range corresponding in location with the grooves 11 and 12 in the surface of the magnet, and at any point in this range the magnetic field strength is lower than the field strength at any point lying on the same descriptive in the intermediate range, i.e., in the region along the cylinder surface between the bandlike ranges.

Consequently, when magnetically attractable powder is supplied to the surface of the cylinder 1 in the region lying between the bandlike ranges having lower field strength, upon rotation of the cylinder in the direction in which the bandlike ranges extend inward this powder will move in axial direction only up to the inner edges of the bandlike ranges, and will subsequently move inwardly along these edges up to the ends of the bandlike ranges. Magnetically attractable powder particles which are supplied onto the bandlike ranges or outside them on the cylinder 1 are upon rotation of the cylinder automatically transported inwardly to the region lying between the bandlike ranges, as a result of the spiral pattern of the bandlike ranges. Thus, according to the invention, powder transport is prevented from taking place toward the extremities of the cylinder, and it also results even that powder particles supplied to the extremities of the cylinder, for instance because of a faulty introduction of powder, are moved away from these extremities toward more inwardly situated parts of the cylinder.

In the embodiment represented in FIG. 1, the pitch angle of the grooves 11 and 12 is about 12°, the width of the grooves at the surface of the magnet is about 10 mm, and their greatest depth is about 5 mm. The degree of the pitch angle and the width and depth of the grooves are determined mainly by the diameter of the cylinder 1, the speed of rotation of the cylinder and the properties of the powder to be transported, such as its streaming behavior and magnetic properties, but the manner of this determination is not critical. In general, the width of each groove is chosen between about 5 and 15 mm, while the greatest depth amounts to at least 2 mm. The pitch angle generally lies between 5° and 25° and in most cases is between 10° and 15°.

In the embodiment of the invention shown in FIG. 1 the grooves 11 and 12 made in the magnet 10 have a constant pitch. It is also practicable to make the grooves with a varying pitch, but for technical reasons a constant pitch is preferred. Instead of a V-shaped groove it is of course also practicable to employ a different groove shape, for instance a U-shaped groove formed into the surface of the magnet 10.

According to a variant of the invention, the grooves 11 and 12 are fully or partially filled with a material having a greater magnetic permeability than air, in order thus to obtain an even lower field strength in the bandlike ranges. For instance, the grooves can be filled with a strip of soft iron.

According to another embodiment of the invention, the bandlike ranges of lower field strength extending spirally with a constant or a varying pitch are obtained by applying spirally onto the magnet 10 near each of its ends a thin strip of a material having higher magnetic permeability than air, for instance soft iron.

Figure 2:
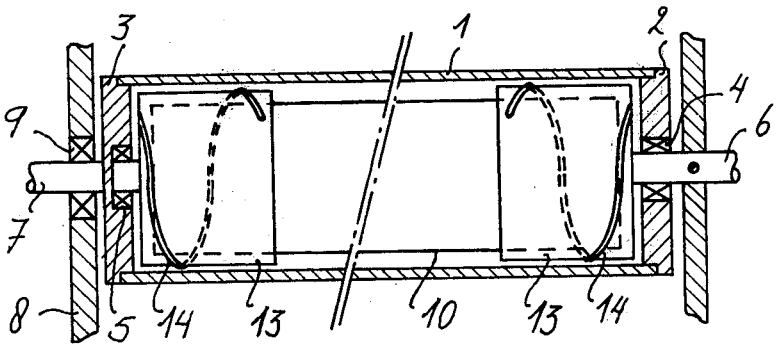
FIG. 2 is a schematic cross sectional view of a magnetic roller according to another embodiment of the invention.

In a further embodiment of the invention, as represented in FIG. 2, a bushing 13 of diamagnetic material fixed firmly to the shaft 6 is fitted over each end of the magnet 10, and a strip 14 of a material having a higher magnetic permeability than air, for instance soft iron, is fixed to and extends spirally over the cylindrical part of each bushing.

Variants are also practicable for this embodiment of the invention. For instance, each bushing 13 can be mounted rotatably in bearings on shaft 6 instead of being firmly mounted thereon, and drive means can be provided to rotate the bushing in the same direction as the cylinder 1 or in opposite direction. The direction and the speed of rotation of the bushing are normally chosen so that the bandlike ranges of deviating field strength extend from the cylinder ends inwardly as seen in the direction of rotation of the cylinder 1.

In the embodiments represented in FIGS. 1 and 2 the bandlike range of deviating field strength near each extremity of the cylinder extends over more than one circumference of the cylinder. It will be clear, however, that these ranges may also extend two or more times over the cylinder circumference. On the other hand, embodiments are also effective in which the bandlike ranges of deviating field strength extend over less than one circumference of the cylinder.

In the embodiments of the invention described above the field strength in the bandlike ranges of deviating field strength near the extremities of the cylinder is in each case lower than the field strength in the intermediate region. It is also practicable, however, to provide bandlike ranges having a field strength higher than that in the intermediate region, by making the magnets which generate the magnetic field more magnetic in a narrow zone extending spirally over their cylindrical surface near each extremity thereof than in the remaining ranges.

The magnetic rollers provided according to the invention can be used advantageously, for instance, in apparatus for the development of latent electrostatic charge images with magnetically attractable developing powder, and these rollers are also useful in cleaning devices for removing magnetically attractable powder from for instance a photoconductive surface.

Figure 3:
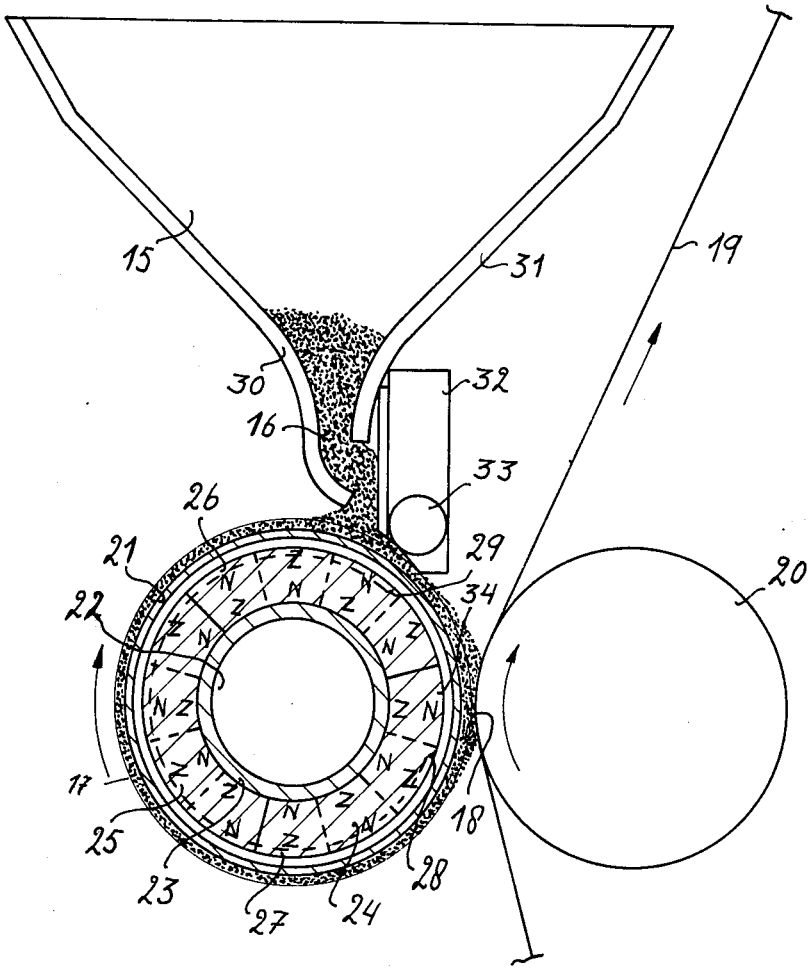
FIG. 3 is a schematic representation, partly in cross section, of a developing apparatus in which a magnetic roller according to the invention is used for the development of electrostatic images.

An apparatus utilizing a magnetic roller of the invention for the development of latent electrostatic charge images is represented schematically in FIG. 3. This developing device comprises a reservoir 15 for magnetically attractable developing powder, from which reservoir the developing powder is supplied via the opening 16 to the cylinder of a magnetic roller 17 according to the invention. The magnetic roller 17 transports the developing powder to a developing zone 18 where the powder is brought into contact with a sheet or web 19 of photoconductive material. This material is supplied over a supporting roller 20 and carries a latent electrostatic charge image at its side facing the powder layer. The powder remaining on the magnetic roller 17 after the development is returned on this roller from the developing zone 18 to the powder supply zone.

The magnetic roller 17 comprises a cylinder 21 of diamagnetic material, which cylinder is mounted rotatably in bearings on the shaft 22 of the roller as described above with regard to the shaft 6 in FIG. 1. The cylinder rotates in the direction indicated by the arrow, while the shaft 22 is firmly fixed in a frame plate of the apparatus. A soft iron tube 23 having a wall thickness of about 3 mm is firmly mounted about the shaft 22, and on the tube 23 are fixed magnetic segments 24, 25 and 26 which are adhered against each other so that together they form a cylindrical magnet. Each segment is magnetized in radial direction, with alternations of the magnetic poles in circumferential direction so that N poles and S poles extending in axial direction alternate at the surface of each segment. The total number of magnetic poles around the circumference of the cylindrical magnet amounts to 12 in the embodiment represented, but this number and/or the number of segments employed may be greater or smaller. The magnetic segments may be composed of any of various materials known for the manufacture of permanent magnets, for instance of ferrite powder dispersed in a suitable carrier resin. See French Pat. No. 1,566,007. Preferably the segments contain anisotropic, radially directed, sintered ferrite, which enables them to be given a high degree of magnetization. Such magnetic segments are available commercially under the name 'Ferroxdure 330 rad.'

A spirally extending V-shaped groove 27 is made in the surface of the cylindrical magnet formed by the segments 24, 25 and 26 near each extremity of the magnet. Each of these grooves extends over less than one circumference of the magnet and, as viewed in FIG. 3 in the direction of rotation of the cylinder 21, runs spirally inward from a point 28 at the end of the magnet immediately after the developing zone 18 to a point 29 in the powder supply zone. The pitch angle of the grooves 27 amounts to about 12°. Their width is about 7 mm, and their greatest depth is about 4 mm.

The magnetically attractable developing powder is supplied to the cylinder 21 via the opening 16 of the reservoir 15. The side wall 30 of the reservoir is shaped according to an exponential curve in order to obtain a good outflow of the developing powder. The opening 16 of the reservoir 15 extends in axial direction over approximately one third of the cylinder length and is situated centrally above the cylinder. Near the opening 16 a guide member or spreader 32 is installed, which extends in axial direction over the whole cylinder length and spreads the supplied developing powder over the cylinder 21, and beyond the bandlike ranges having lower field strength, but not up to the extremities of the cylinder. The spreader 32 is mounted rotatably on a shaft 33 so that it can control the thickness of the powder layer applied onto the cylinder. The cylinder 21 carries the layer of supplied developing powder to the developing zone 18, where by the influence of the magnetic field present between the support roller 20 and the magnetic pole 34, particles of the powder are forced into the form of a developing brush which is brought into contact with the electrostatic charge image to be developed. The developing powder not transferred to the charge image, after being transported through the developing zone 18, is carried further on the cylinder 21 toward the powder supply zone, thereby being transported through a path in which it is enclosed between the bandlike ranges 27 of lower field strength present near and extending spirally inward from the extremities of the cylinder, with the result that a powder transport which is continually directed inwards takes place near each extremity of the cylinder.

It will be obvious that the magnetic rollers according to the invention can be used to advantages not only in developing devices employing a single magnetic roller, but also in developing devices which contain two or more magnetic rollers, for instance in devices of the type described in British Pat. Specification No. 1,251,477. In the latter case it is of course practicable to use magnetic rollers in which a magnetic field and pertaining bandlike ranges of deviating field strength are generated only over that part of the cylinder circumference over which transport of magnetically attractable powder takes place.

What is claimed is:

1. In a magnetic roller comprising a rotatable diamagnetic cylinder and magnet means inside the cylinder for generating a magnetic field throughout an elongate region extending axially of the cylinder over at least a part of its circumference, the improvement which comprises means associated with said magnet means for forming in said magnetic field near each extremity of said region a spirally extending bandlike field range in which the field stength at any point deviates from the field strength at any point lying on the same descriptive in the part of said region between the bandlike ranges.

2. A magnetic roller according to claim 1, said range forming means forming at any point in each said bandlike range a field strength smaller than the field strength at any point lying on said descriptive.

3. A magnetic roller according to claim 1, said magnet means comprising a plurality of axially extending arcuate permanent magnets disposed side by side to present a substantially continuous outer surface, said range forming means comprising a groove extending spirally in said outer surface of said magnets near each extremity thereof.

4. A magnetic roller according to claim 3, said groove being filled with material having a greater magnetic permeability than air.

5. A magnetic roller according to claim 3, said groove being filled with soft iron.

6. A magnetic roller according to claim 3, the pitch of said groove being substantially uniform.

7. A magnetic roller according to claim 1, said range forming means comprising between said magnetic means and said cylinder near each said extremity a spirally extending strip of material having a greater magnetic permeability than air.

8. A magnetic roller according to claim 7, said magnet means comprising a plurality of axially extending arcuate magnets disposed side by side to present a substantially continuous outer surface, each said strip being fixed to said surface of said magnets.

9. A magnetic roller according to claim 7, each said strip being fixed to a diamagnetic sleeve fitted over an end portion of said magnetic means.

10. A magnetic roller according to claim 9, each said sleeve being rotatable relative to said magnets.

11. A magnetic roller according to claim 1, said magnet means being constituted by permanent magnets composed of anisotropic, radially directed sintered ferrite particles.

12. In apparatus for the development of electrostatic charge images with magnetically attractable developing power, including a reservoir for a supply of said powder and at least one magnetic roller for transporting powder between said supply and said images, the improvement which comprises said roller being a magnetic roller according to claim 1.

13. Apparatus according to claim 12, each said bandlike field range of said roller extending spirally inward from the adjacent extremity of the cylinder of said roller in the direction of rotation of said cylinder.

14. Apparatus according to claim 12 and in which a support for image bearing material arranged opposite one said magnetic roller defines therebetween a developing zone into which a layer of said powder is transported by rotation of the cylinder of said magnetic roller, each said bandlike field range of said magnetic roller extending spirally inward in the direction of said rotation from a location at the adjacent extremity of and just beyond said developing zone to a location of engagement of said cylinder by powder of said supply.

15. In a magnetic roller comprising a rotatable cylinder of diamagnetic material and a cylindrical magnet extending axially inside said cylinder so as to generate a magnetic field about said cylinder, said magnet comprising a plurality of axially extending arcuate segments joined together and forming circumferentially of said magnet a series of permanently magnetized regions alternating in polarity, the improvement which comprises said magnet having in its outer surface near each extremity thereof a groove extending spirally inward in the direction of rotation of said cylinder, each said groove forming about the outer surface of said cylinder a spirally extending bandlike magnetic field range of reduced field strength whereby magnetically attractable particles at said cylinder surface will be attracted preferentially to regions of the cylinder surface inward of said grooves.

16. A magnetic roller according to claim 15, each said groove having a pitch angle of between 5° and 25°, a width of between 5 and 15 mm. at said magnet surface and a depth of at least 2 mm.

* * * * *